United States Patent [19]

Carrotte et al.

[11] Patent Number: 4,764,875

[45] Date of Patent: Aug. 16, 1988

[54] POSITIVE YARN FEED

[76] Inventors: Frederick H. Carrotte, 9 Barry Drive, Kirby Muxloe, Leicestershire, England; John R. Stewart, 241 South Water St., Unit 9, East Windsor, United Kingdom; Kurt Jacobsson, Stenasgaten 11, S-52300, Ulricehamn, Sweden

[21] Appl. No.: 822,309

[22] PCT Filed: Apr. 26, 1985

[86] PCT No.: PCT/GB85/00181

§ 371 Date: Dec. 24, 1985

§ 102(e) Date: Dec. 24, 1985

[87] PCT Pub. No.: WO85/04909

PCT Pub. Date: Nov. 7, 1985

[30] Foreign Application Priority Data

Apr. 26, 1984 [GB] United Kingdom ..... 8410640

[51] Int. Cl.[4] ..... G06F 15/46; D04B 15/48

[52] U.S. Cl. ..... 364/470; 66/125 R; 66/132 T; 364/173

[58] Field of Search ..... 364/470, 468, 469, 172, 364/173; 66/1 R, 125 R, 132 R, 132 T, 163; 242/45, 128, 130, 131, 131.1; 226/42, 91

[56] References Cited

U.S. PATENT DOCUMENTS

| | | | |
|---|---|---|---|
| 0028412 | 5/1981 | EPX . | |
| 1585199 | 2/1972 | DEX . | |
| 3002311 | 7/1981 | DEX . | |
| 3,780,541 | 12/1973 | Haynes | 66/125 R |
| 3,858,416 | 1/1975 | White et al. | 66/132 R |
| 4,027,505 | 6/1977 | Mischon et al. | 66/125 R |
| 4,194,375 | 3/1980 | Marchisio | 66/132 T |
| 4,386,508 | 6/1983 | Jacobsson | 66/132 T |
| 4,527,402 | 7/1985 | Swallow et al. | 364/470 X |
| 4,574,353 | 3/1986 | Hellstrom et al. | 364/470 |

*Primary Examiner*—Joseph Ruggiero

*Attorney, Agent, or Firm*—Frijouf, Rust & Pyle

[57] ABSTRACT

A positive yarn feed device comprises a pin wheel mechanism (3,4,8,9,10,11) with independent drive means which comprise a variable-speed electric motor (16). The speed of the DC motor (16) is controlled by programmed control means (24,28) which exercise control on the basis of a comparison between an input from speed sensing means (26) associated with the yarn feed device and an input representative of the speed of the cylinder (20) of a circular knitting machine to which the yarn is fed. The comparison of the speed input signals is evaluated against desired speed ratio data stored in a look-up table (31) in programmable memory M. Motor speed control signals output from a microprocessor unit (24) control a variable speed drive unit (28) which directly controls the speed of the motor (16).

14 Claims, 13 Drawing Sheets

Table I.
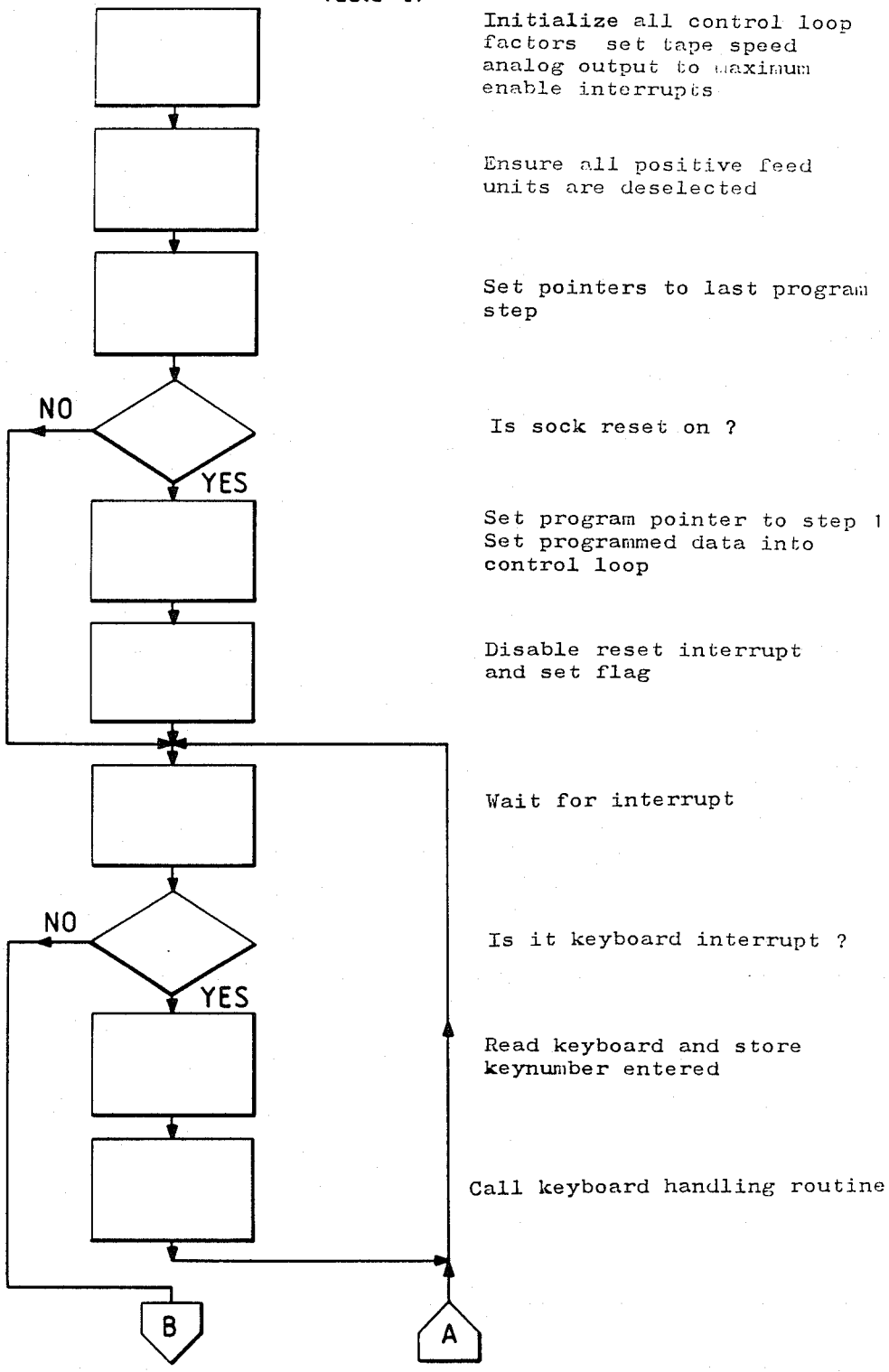

Table II
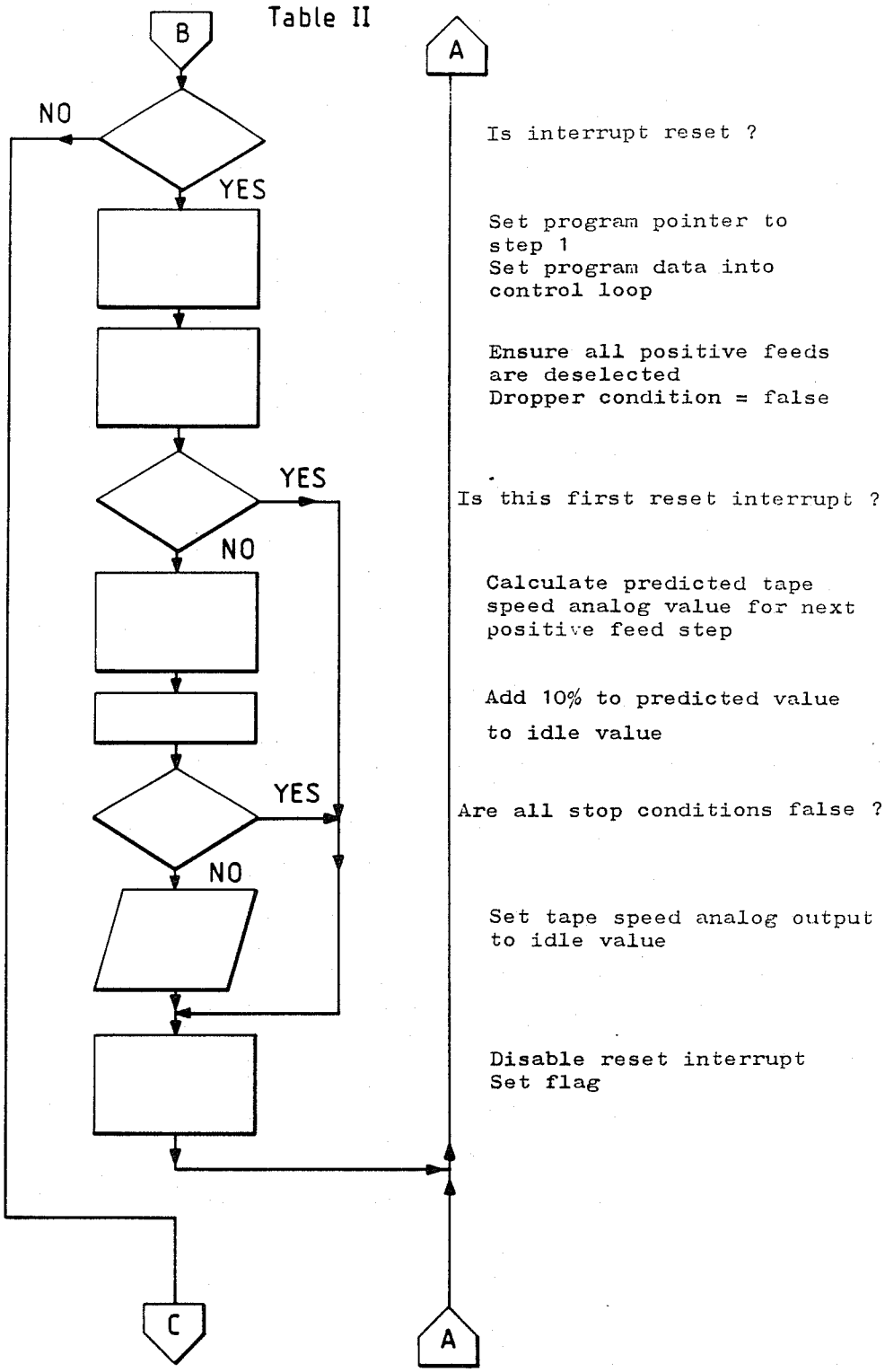

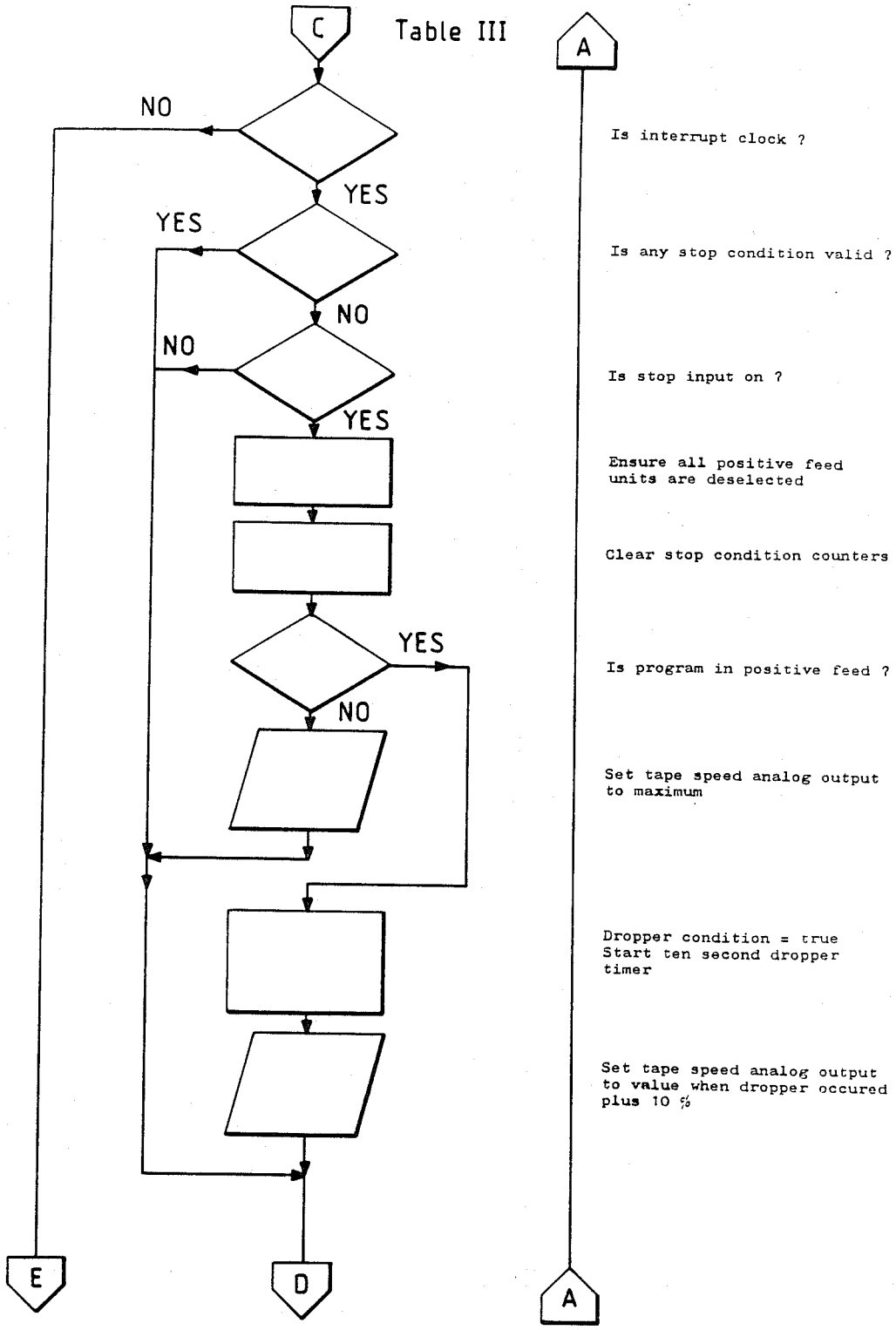
C
Table III
A
NO
YES
YES
NO
NO
YES
YES
NO
E
D
A
Is interrupt clock ?
Is any stop condition valid ?
Is stop input on ?
Ensure all positive feed units are deselected
Clear stop condition counters
Is program in positive feed ?
Set tape speed analog output to maximum
Dropper condition = true
Start ten second dropper timer
Set tape speed analog output to value when dropper occured plus 10 %

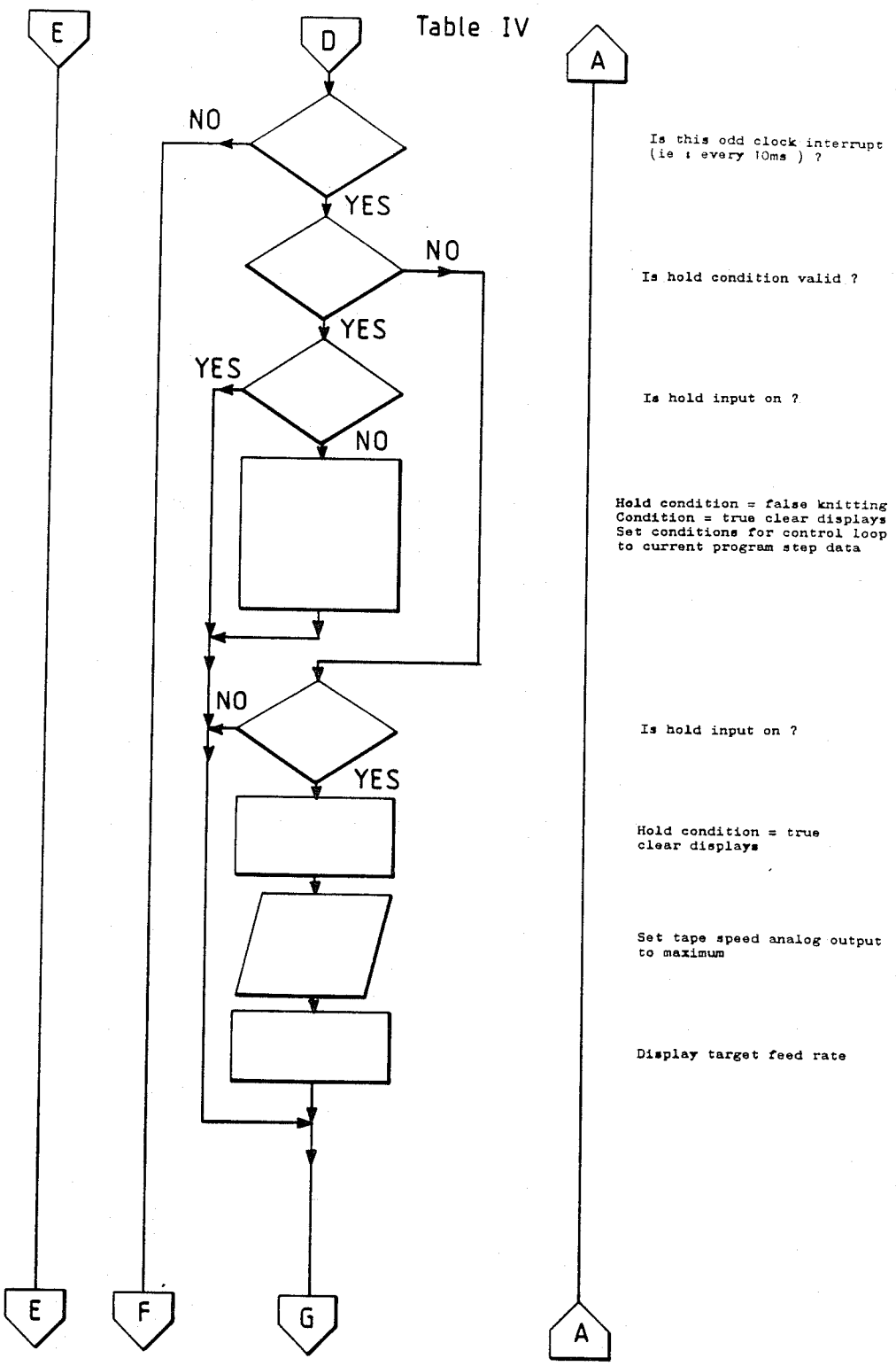
Table IV
E
D
A
NO
YES
NO
YES
YES
NO
NO
YES
Is this odd clock interrupt (ie : every 10ms ) ?
Is hold condition valid ?
Is hold input on ?
Hold condition = false knitting
Condition = true clear displays
Set conditions for control loop to current program step data
Is hold input on ?
Hold condition = true
clear displays
Set tape speed analog output to maximum
Display target feed rate
E
F
G
A

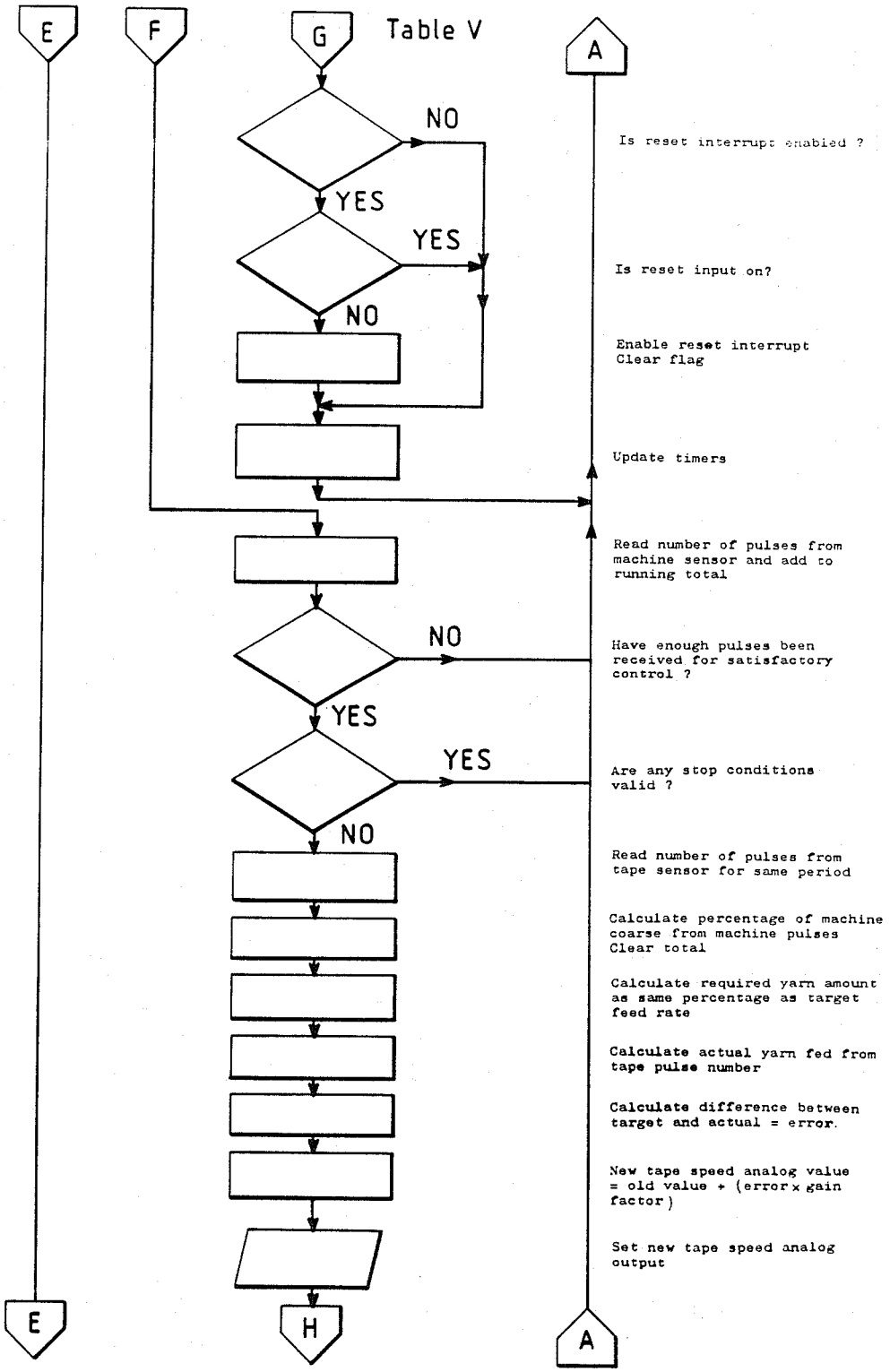
E
F
G
Table V
A
NO
YES
YES
NO
Is reset interrupt enabled ?
Is reset input on?
Enable reset interrupt
Clear flag
Update timers
Read number of pulses from machine sensor and add to running total
NO
YES
Have enough pulses been received for satisfactory control ?
YES
NO
Are any stop conditions valid ?
Read number of pulses from tape sensor for same period
Calculate percentage of machine coarse from machine pulses
Clear total
Calculate required yarn amount as same percentage as target feed rate
Calculate actual yarn fed from tape pulse number
Calculate difference between target and actual = error.
New tape speed analog value = old value + (error x gain factor)
Set new tape speed analog output
E
H
A

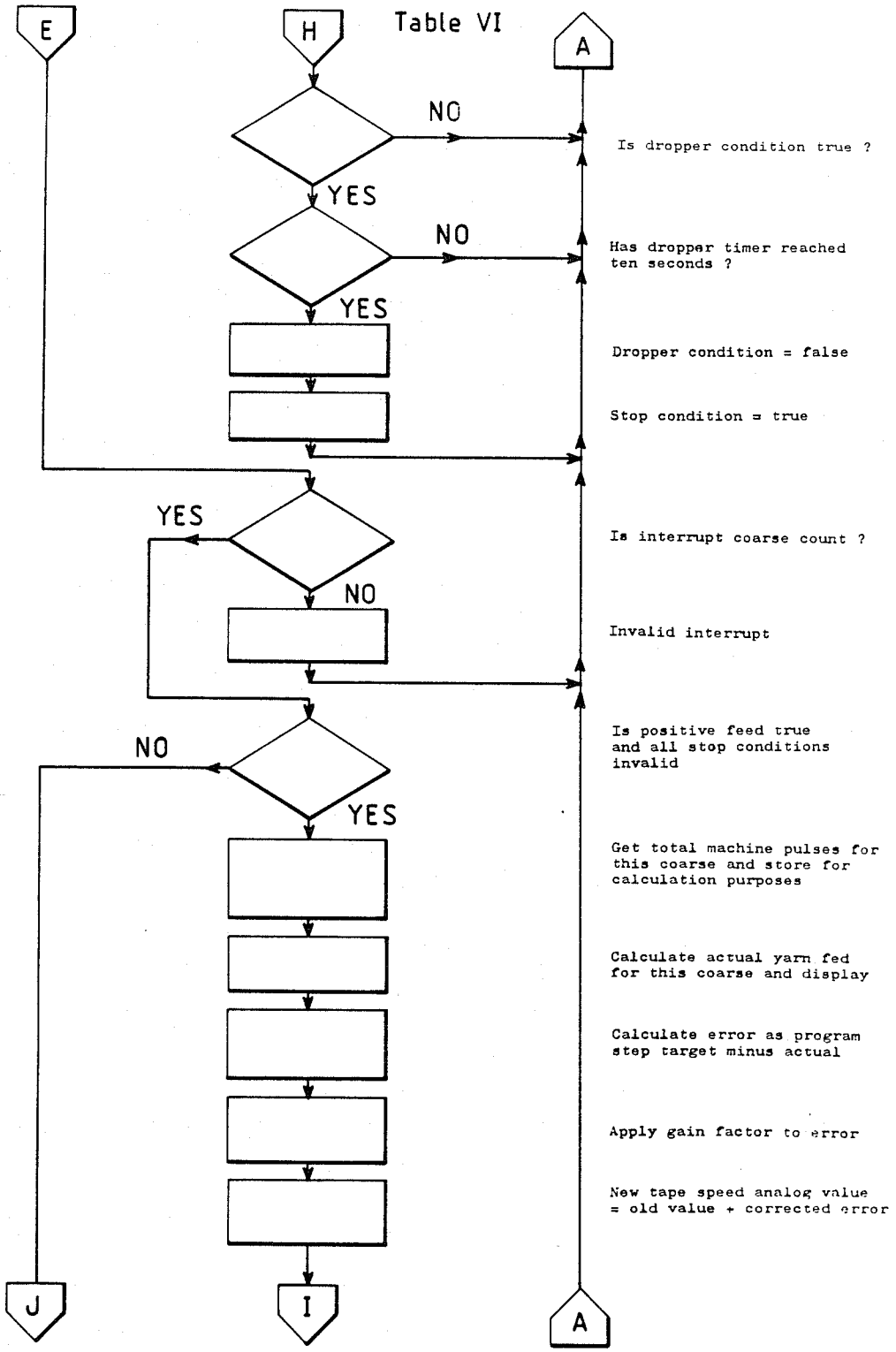
Table VI
E
H
A
NO
YES
Is dropper condition true ?
NO
YES
Has dropper timer reached ten seconds ?
Dropper condition = false
Stop condition = true
YES
NO
Is interrupt coarse count ?
Invalid interrupt
NO
YES
Is positive feed true and all stop conditions invalid
Get total machine pulses for this coarse and store for calculation purposes
Calculate actual yarn fed for this coarse and display
Calculate error as program step target minus actual
Apply gain factor to error
New tape speed analog value = old value + corrected error
J
I
A

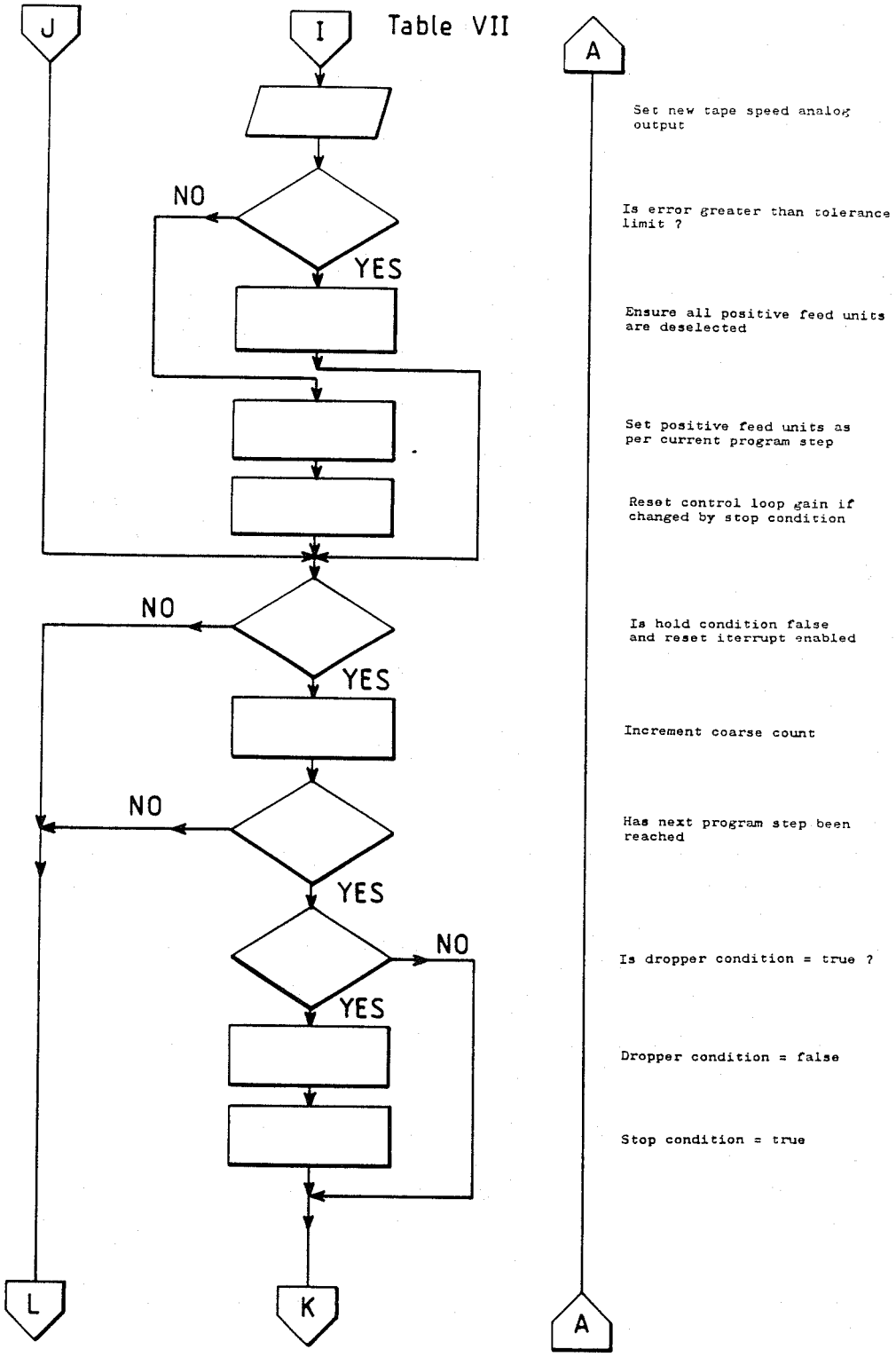
Table VII
J
I
A
Set new tape speed analog output
NO
YES
Is error greater than tolerance limit ?
Ensure all positive feed units are deselected
Set positive feed units as per current program step
Reset control loop gain if changed by stop condition
NO
YES
Is hold condition false and reset iterrupt enabled
Increment coarse count
NO
YES
Has next program step been reached
NO
YES
Is dropper condition = true ?
Dropper condition = false
Stop condition = true
L
K
A

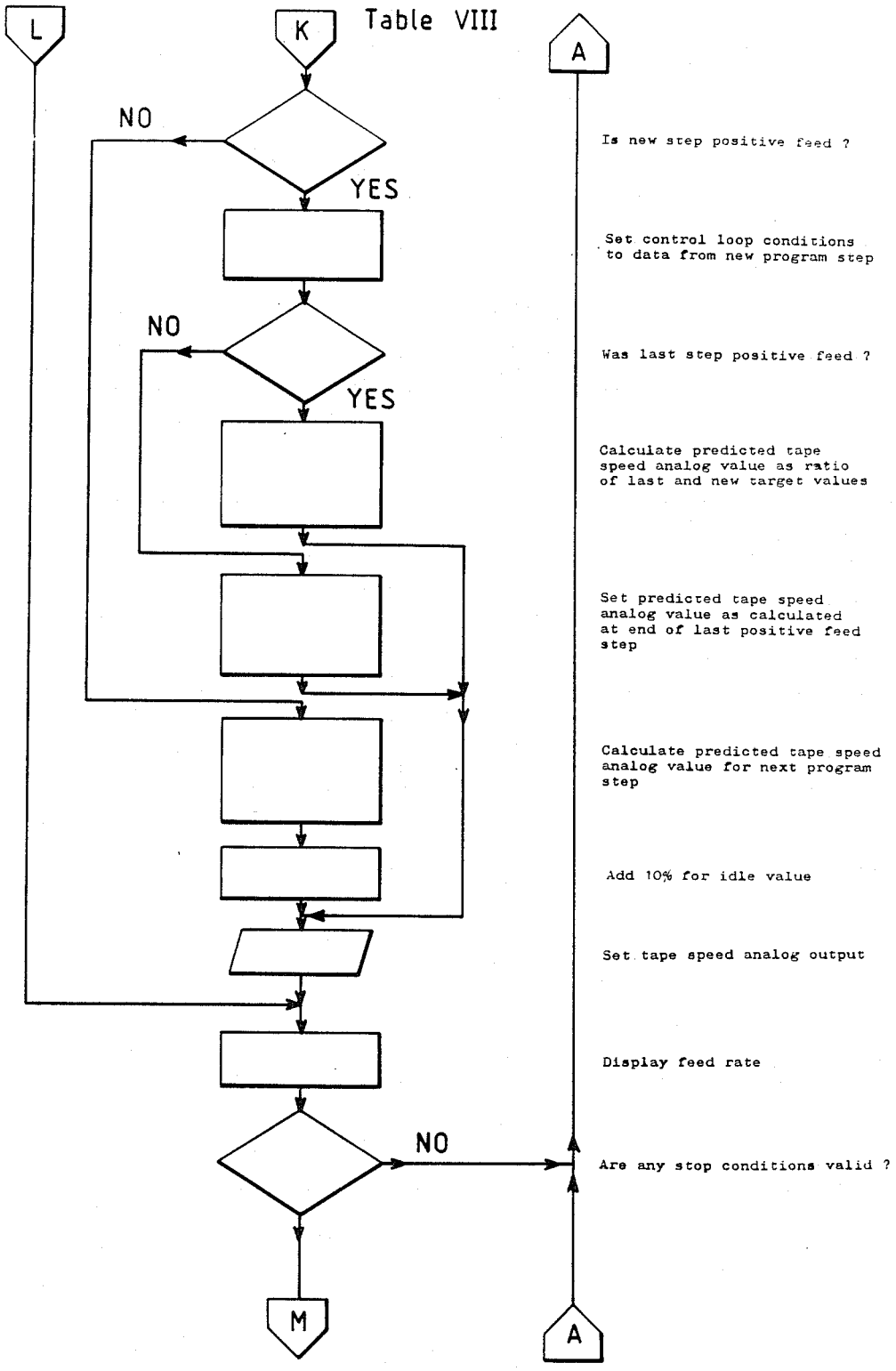
Table VIII
L
K
A
NO
YES
Is new step positive feed ?
Set control loop conditions to data from new program step
NO
YES
Was last step positive feed ?
Calculate predicted tape speed analog value as ratio of last and new target values
Set predicted tape speed analog value as calculated at end of last positive feed step
Calculate predicted tape speed analog value for next program step
Add 10% for idle value
Set tape speed analog output
Display feed rate
NO
Are any stop conditions valid ?
M
A Table IX
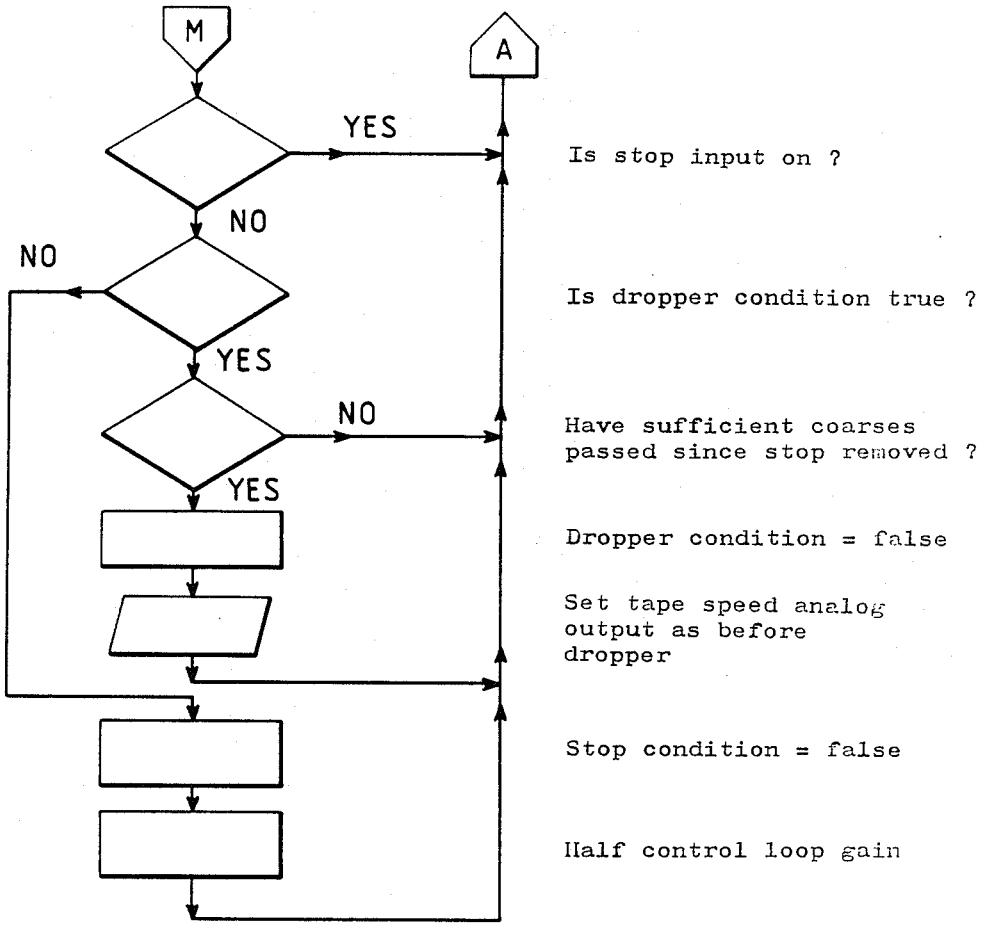

POSITIVE YARN FEED

BACKGROUND OF THE INVENTION

The present invention relates to positive yarn feed devices and techniques, in particular for feeding yarns to circular knitting machines.

The yarn feeding of half hose knitting machines presents considerable problems, it conventionally not being possible to knit socks which are dimensionally stable. The climax to the process of sock making is normally a tedious pairing operation, which is necessary to ensure that the socks of a pair thereof when sold, washed and worn remain dimensionally matched. Socks knitted in certain yarns and stitch constructions can come off the knitting machine with a size variation with respect to the nominal size of as much as ±1 inch.

Changes in stitch density in fabrics coming from any knitting machine or bank of knitting machines result from variables in the knitting process, such as yarn tension and needle friction among others. In the case of half hose production these variables exhibit themselves in the form of size variation due mainly to the cumulative effect of small changes in stitch length.

To overcome these problems the concept of positive yarn control has been introduced, using positive yarn feed devices which are mounted on the creel frame which supports the yarn packages and which are driven mechanically from the knitting machine. The need for the mechanical drive restricts the scope for positioning of the creel frame, complicates the knitting machine and makes it difficult, in some cases impossible, to fit positive feed devices to existing knitting machines. In addition the drive may overload the motor driving the knitting machine, and high loads with associated wear and failure are imposed on the drive shafts and couplings. Furthermore, for garment manufacture and particularly for sock manufacture the yarn feed needs to be programmed throughout the mechanical cycle of the machine during garment production. Such programming is difficult and essentially limited in scope with the mechanically-driven devices.

For the mechanically-driven positive feed of yarn pin wheel and tape drive mechanisms have been developed. Such mechanisms are well known, with the yarn passing around the pin wheel beneath the tape which is continuous and also passes around a so-called quality wheel by which it is driven to provide a positive feed of the yarn gripped between the tape and the pin wheel. The quality wheel is of calibrated and variable diameter, so that the tape speed and hence the yarn feed can be adjusted to draw the yarn from its package and deliver it to the knitting needles at a constant and predetermined rate suited to the knitting procedure.

An advantage of a pin wheel mechanism is that by changing the inlet path of the yarn it can be slipped from under the tape to provide a free running yarn. If, in the case of half hose, the leg and the foot can be knitted under positive yarn feed it is of little significance that the yarn is free running during knitting of the toe, heel, and welt of the sock. The present invention is of particularly valuable application to devices incorporating a pin wheel mechanism, utilising the facility of the latter to provide at will either positive yarn feed control or a free running yarn.

An object of the invention is to overcome the disadvantages of mechanical drive arrangements and to provide more accurate yarn control. A further object is to provide yarn feed control devices and techniques which can utilise a pin wheel mechanism and thus retain the inherent advantages thereof, particularly the advantage of being able to change at will from a positive feed condition to a free running condition.

SUMMARY OF THE INVENTION

According to one aspect of the invention a positive yarn feed device is independently driven by means of a variable-speed electric motor drive the speed of which is controlled by programmed control means which exercise control on the basis of a comparison between a signal from speed sensing means associated with the yarn feed device (second speed sensing means) and a signal representative of the speed of the cylinder or a knitting machine to which the yarn is fed (first speed sensing means).

The control means preferably operate to maintain a predetermined required ratio between a driven speed of the yarn feed device and the cylinder speed. The control means may incorporate a microprocessor associated with programmable memory, the microprocessor providing a speed control signal determined by said comparison made by the microprocessor which is also supplied with a desired control ratio input from the memory. Thus the microprocessor exercises control via a feedback loop, and the programmable memory is preferably of EPROM type which may be programmed by a hand-held keypad terminal. This terminal may be of plug-in form, so that the same terminal can be used to programme a number of machines, and it may incorporate a digital display of information such as the instantaneous yarn speed per machine revolution and the position of the knitting machine within its operative signal.

Preferably the yarn feed device incorporates a pin wheel mechanism, with the second speed sensing means providing a signal representative of the speed of a quality wheel of the mechanism and hence representative of the speed of the pin wheel. The speed sensing means may be of digital type, producing a train of pulses a count of which is indicative of the number of revolutions of the positive yarn feed drive or the knitting machine cylinder, as the case may be.

According to another aspect of the invention, a positive yarn feed device incorporates a pin wheel mechanism a tape-driving quality wheel of which has an independent variable-speed electric motor drive. It will be appreciated that the quality wheel, although it drives the tape associated with the pin wheel in the usual manner is no longer essentially adjustable for speed variation although it conveniently still is. Preferably the device incorporates speed sensing means which provide a feedback signal dependent directly or indirectly on the speed of the pin wheel, for connection in a feedback loop with control means of the motor drive comprising a fixed logic device programmed to be in sympathy with the knitting cycle.

Tests have shown that mis-plating is a common problem associated with sock manufacture, and two yarns guided into one feed without control can sometimes exhibit erratic behaviour and cause mis-plating. To overcome this problem the device of the invention may be provided with a tandem pin wheel unit, the two wheels being independently driven by separate tapes and individual quality wheels. This allows the two yarns to run at slightly different speeds with an immediate improvement in plating quality. The differential speed of the two yarns may be achieved by appropriate relative adjustment of the two quality wheels, or alternatively separate variable-speed motor drives may be provided for the quality wheels with each drive being associated with its own speed sensing means to provide independent feedback speed control of the two pin wheels.

The yarn control device may incorporate a solenoid which is operated by the control means and operative to move a yarn guide to change the yarn path and thus change the yarn from a positive feed to a free feed state. Thus a free feed may be provided over certain sections of the knitting programme, and/or for appropriate periods between speed changes to prevent yarn breakage or yarn snatch with consequent loss of machine performance. The yarn control device may also incorporate breakage sensing means, such as a switch coupled to a tensioning yarn guide, which provides a signal for operation of the stop motion of the knitting machine.

BRIEF DESCRIPTION OF THE DRAWINGS

The invention will now be further described with reference to the accompanying drawings which illustrate, diagrammatically and by way of example, one preferred embodiment of the invention. In the drawings.

Tables I–IX are a flow chart of the steps carried out during operation of the system.

DETAILED DESCRIPTION

Figure 1:
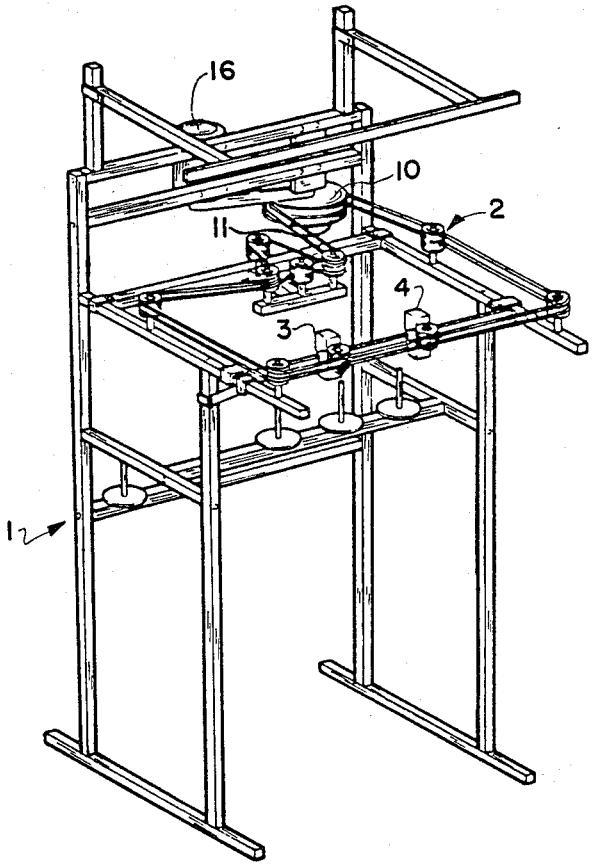
FIG. 1 illustrates a creel stand fitted with positive yarn feed devices in accordance with the invention.

FIG. 1 shows a creel stand 1 the top tackle of which incorporates a pin wheel mechanism 2 embodying pin wheel units 3 and 4 which are basically of conventional form. The tandem pin wheels 6 and 7 of each unit 3 or 4 are independently driven by two endless tapes 8 and 9 respectively driven, in the usual manner, by two quality wheels 10 and 11. Input and ouput eyelets 12 and 13 are associated with the pin wheel 6, and input and output eyelets 14 and 15 similarly associated with the pin wheel 7.

The quality wheels 10 and 11 are of adjustable diameter, which allows differential adjustment of the speeds of the tapes 8 and 9 and thus of the rotational speeds of the pin wheels 6 and 7. Hence different yarns may be introduced with appropriate qualities. Both quality wheels 10 and 11 are driven by a geared DC shunt motor 16 of variable-speed type, speed variation being achieved by modulation of the motor armature current. The provision of two feeds, and therefore of two tapes and two positive feed units as in the present embodiment, will be the most common arrangement. The maximum likely to be required is three tapes with three positive feed units. The D.C. motor may alternatively be an A.C. variable speed motor.

A rear casing 17 of each pin wheel unit 3 or 4 houses two solenoids (not shown) which are respectively operative to move the input eyelets 12 and 14 between positive feed positions, in which the respective yarns are positively fed between the pin wheels 6 and 7 and the tapes 8 and 9, and free feed positions in which the yarns pass freely across the pin wheels 6 and 7. The casing 17 also contains stop motion switches (also not shown) respectively coupled to the output eyelets 13 and 15, which are movable and tension the yarn in the usual manner, to operate the stop motion of the associated knitting machine in the event of yarn breakage.

Figure 3:
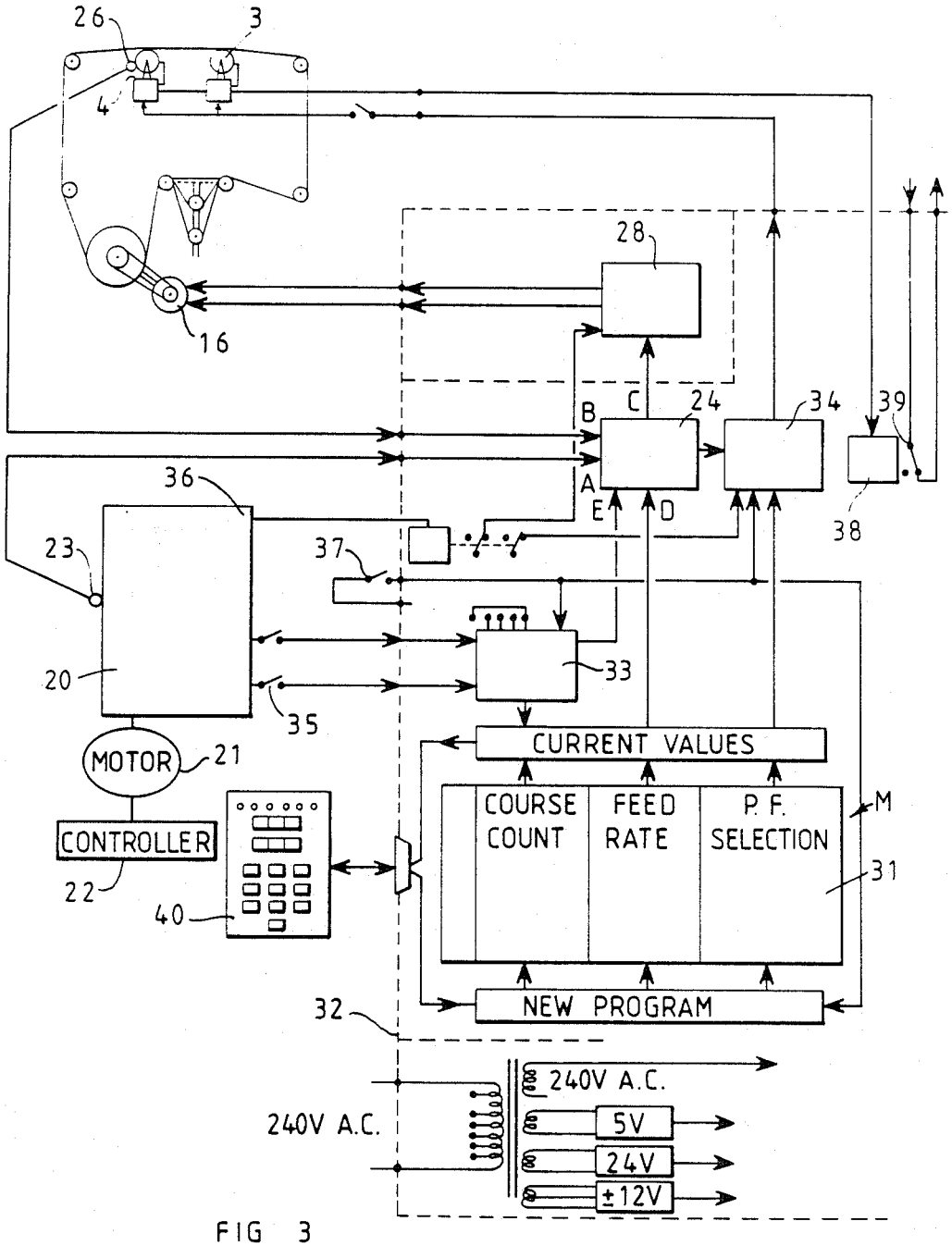
FIG. 3 is a schematic diagram of the control system of the embodiment.
Figure 4:
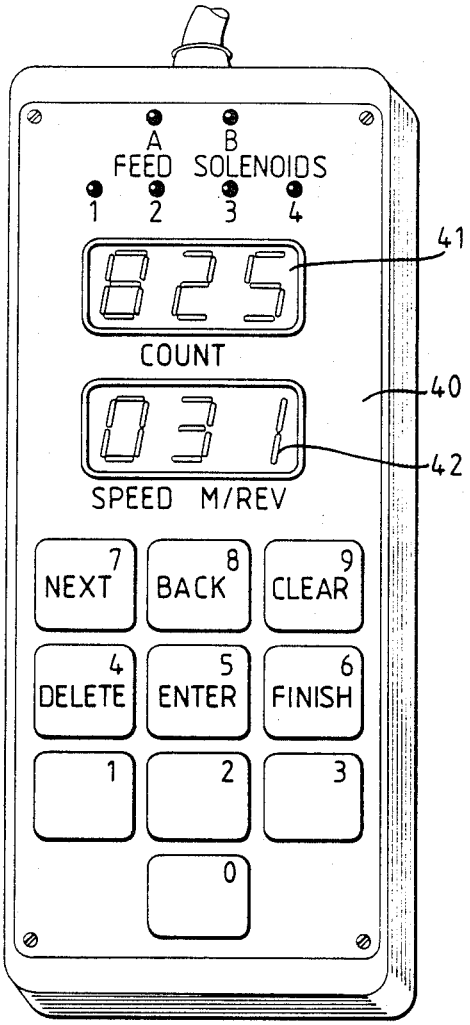
FIG. 4 depicts a hand-held programming terminal.

Referring now to the control system diagram of FIG. 3, the cylinder 20 of the circular knitting machine is driven by its own motor 21 at a speed which is typically between 200 and 400 rpm dependent on the machine model. The motor 21 has its own controller 22. A pulse generator 23 comprises a proximity sensor associated with a gearwheel in the drive train of the cylinder 20, and thus a pulse output indicative of the rotational speed of the cylinder 20 is supplied to one input A of speed control unit 24, the number of teeth on the gearwheel representing the number of pulses generated for each revolution of the gearwheel. It is necessary that the gearwheel associated with the pulse generator 23 should rotate an integral number of turns for each complete revolution of the machine cylinder 20, for example between 35 and 90 pulses being generated per cylinder revolution. In one specific example the knitting machine runs at between 350 and 380 rpm and 37 pulses are generated per revolution, giving a pulse rate of 234 Hz at top speed.

The variable-speed motor 16 drives the quality wheels 10 and 11, optionally through a gearbox, and a pulse generator 26 associated with a positive feed pin wheel generates a pulse train indicative of the speed thereof and which is fed to a second input B of the control unit 24. The pin wheel is constructed with 32 pins separated by an air gap so that 32 pulses are generated per revolution of the pin wheel. The generator may alternatively be associated with the gearbox output shaft where the speed is nominally in the range 500 to 1000 rpm and the pulse generator 26 supplies 20 pulses per revolution. Thus a maximum pulse rate of 333 Hz is provided.

A DC drive control unit 28 provides constant energization of the motor shunt field coil and modulated current to the motor armature for speed control of the motor 16. It is itself controlled by a speed control signal from output C of the control unit 24, this signal being derived as a result of a comparison of the feedback input signal at B with the machine speed input signal at A, the comparison being evaluated against a desired speed ratio signal supplied to an input D of the control unit 24. The microprocessor based unit 24 operates to control the motor 16 to maintain the desired ratio between the number of pulses received from the cylinder generator 23 and the number of pulses received from the feed mechanism generator 26. This required control ratio is defined by the input signal at D and determines the yarn feed rate into the knitting machine under positive feed, and thus the quality of knitting produced. The system thus ensures consistency of socks knitted repeatedly and also permits variation in quality over the length of the sock so that a limited degree of shaping is possible. Since the pulse rate for the positive feed mechanism received at B may significantly exceed the pulse rate for the cylinder received at input A, sufficient control can be exercised to slave the positive feed speed to the cylinder speed with a pre-defined speed ratio. In said specific example, if the speeds were to be matched said control ratio would be 70%.

In order to shape the leg of the sock the speed control ratio must be graduated as a function of the number of courses knitted, that is the number of revolutions of the cylinder 20. A look-up table 31 is thus stored in battery supported memory M (programmable storage means) within the control means all components of which are housed in a casing 32. The cylinder pulses are counted by a counter 33 to determine the number of cylinder revolutions, and at break points defined in the table 31 the number of revolutions counted equates to those defined for a speed change. The speed control ratio imposed on the speed control unit 24 by the appropriate control signal supplied at D is at this point accordingly altered.

In addition to periodic changes in the speed ratio, it is required at different times to engage or dis-engage the yarn from the positive feed drive. This is achieved through a single control output by using a pre-defined speed ratio code, say 99, stored in the memory M. It is desirable to improve the possibilities of positive feed selection and to this end a positive feed selection can be stored in the data table 31 for such selection to occur at various numbers of courses or machine revolutions. Appropriate control signals supplied to a solenoid drive unit 34 result in the latter operating the solenoids of the pin wheel units 3 and 4, to switch the latter in and out of positive feed according to the stored data.

In a typical knitting cycle, the positive yarn feed will be dis-engaged for the starting courses—welt, elastic yarn and start of rib. It will be engaged during the knitting of the leg with graduations in quality by changes in the speed control ratio. The positive feed is dis-engaged for the knitting of the heel but is re-engaged while the foot is knitted. The positive feed is finally dis-engaged for knitting of the tow and the press-off leading to the next sock.

On completion of one sock and the start of the next sock the count of the courses or cylinder revolutions must be re-set. This is achieved by a 'RE-SET' switch 35 operated by the knitting machine at the end of a knitting cycle and which supplies a re-set signal to the counter 33. If the knitting machine is halted a 'STOP' switch 36 supplies a stop signal to input E of the control unit 24 which results in the positive feed drive also stopping. Alternatively or additionally the stop signal is supplied to the drive control 28 and drive unit 34, the latter preferably deselecting positive feed. For setting-up purposes the operator is also able to hold the count of the counter 33, so that the machine quality is not periodically changed. This is achieved by manual operation of a 'HOLD' switch 37.

A separate arm (dropper) of each of the positive feed units 3 and 4 senses the yarn integrity and in the case of yarn breakage, closes the corresponding stop switch to energize a common relay the contacts 39 of which open to operate the stop motion associated with the cylinder drive to stop the knitting machine. The positive feed units have a local indication by lamp of the yarn breakage, with a local re-set button by which the relay 38 can be de-energized to allow the knitting machine to re-start.

The memory M is of EPROM type and information can be entered into the stored data table 31 by a hand-held terminal 40 comprising a keypad which enables the quality and positive feed selection to be set for pre-defined revolutions of the machine cylinder 20. The terminal provides a digital indication 41 of the stage of knitting of the current garment, and it is of plug-in type so that the same terminal can be used for the programming of a number of knitting machines, say up to 10 machines.

In addition to the improved quality of knitting provided by the invention, the independent motor drive of the pin wheel mechanism provides marked installation advantages. Thus the mechanism can be installed in any convenient location, near to or far from the knitting machine. It can be fitted in the traditional position above the machine, or on a fixed creel frame or free-standing creel some distance away from the machine.

The software utilised in the present control system is of a simple nature and its main function is limited to counting the cylinder pulses and retrieving from the stored information the appropriate speed ratio, including the code for positive feed de-selection. Its other function is associated with the hand-held terminal permitting entry and display of the speed ratio graduations. The software function is extendible to embrace the speed control currently carried out by the hardware, and the control of positive feed selection is extendible from the single channel presently provided to two channels as standard and with provision for a total of six channels. The solenoid drive unit 34 has further outputs, in addition to the output shown connected in FIG. 3, and space is provided on the circuit board in the housing 32 for additional relays in the event of an extension of up to six outputs.

The described embodiment utilising separate processor and memory devices is preferred as providing adequate memory which will, in particular, allow for future enhancements. The alternative use of a single-chip microprocessor incorporating programme memory and variable memory on the processor device would in general provide insufficient memory capacity. Provision is made in the present memory M to store positive feed selections on up to six independent outputs, to allow for future enhancement, and to extend to more than one speed ratio to allow different feed tapes to be driven independently at different speed ratios. In that case the independently driven quality wheels of each feed unit need not be of adjustable diameter.

In addition to the 3-digit display of the cylinder pulse count at 41, the terminal 40 has a 3-digit display 42 which displays the yarn speed in engineering units of metres per revolution. Indicator lights show which of the various positive feed unit solenoids is activated, and the 10-key pad has six function keys with the function of each such key being boldly marked thereon. Numeric use of the keys is activated by using the 'zero' key as a shift key.

Use of the positive feed control provided by the invention provides the ability to create consistency of yarn input over a batch of machines which is a valuable production aid in addition to the other benefits gained. For example, 48 separate 2 feed sock machines can be controlled with the same benefits and accuracy as achieved with a large diameter circular knitting machine when fitted with positive feed to retain consistency over all its 96 feeds.

Because the system is not dependent upon yarn or any other outside medium for its prime motion it is possible to predetermine exactly where the positive feeding of yarn shall begin and end. For example, after all the machine perambulations have been completed at the commencement of a sock, and constant yarn speed with balanced cylinder rotation has been achieved, then entirely in the operator's own time i.e. after 1, 2, 3 or even 10 or 20 courses the yarn can be transferred from a free running state into that where the associated pin wheel and tape have it under their control. It will be appreciated that the reverse takes place when approaching the heel, toe, welt or separating course.

Figure 5A:
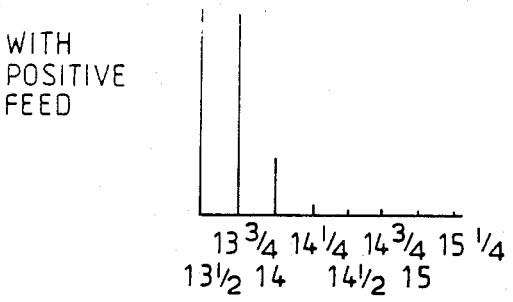
FIGS. 5A–C show histograms illustrative of the improved results achieved with the use of positive yarn feed employing the preferred embodiment.
Figure 5B:
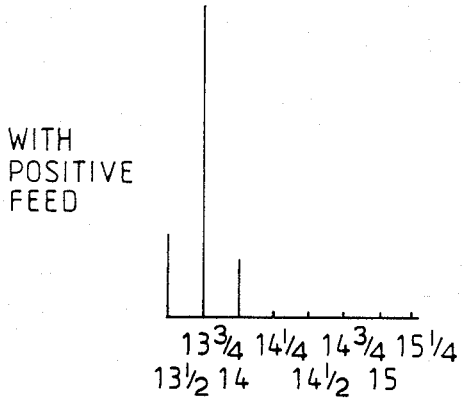
Figure 5C:
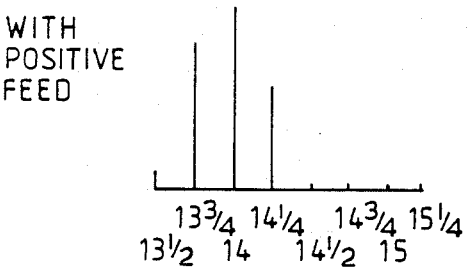
Figure 5D:
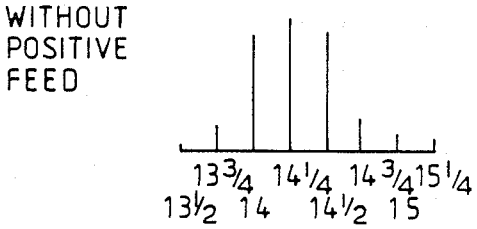
FIGS. 5D–F show histograms illustrative of the results achieved without the use of positive yarn feed.
Figure 5E:
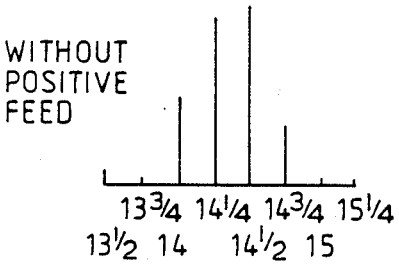
Figure 5F:
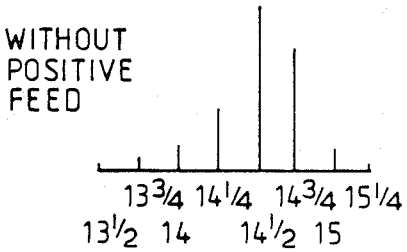

FIGS. 5A, 5B, 5C, 5D, 5E and 5F illustrate in histogram form the result of a series of comparative tests conducted on production machines operating without positive yarn feed (FIGS. 5D, 5E and 5F) and as operating with positive feed control utilising the present control system (FIGS. 5A, 5B and 5C). The histogram FIGS. 5A–5F show the difference in size between statistical samples of 3 shades of the same sock style, FIGS. 5A, 5B AND 5C in each case being all those knitted in positive feed and FIGS. 5D, 5E and 5F in each case being all those knitted out of positive feed. It is clear from FIGS. 5A–5F that when using the positive feed control of the invention the size variations are reduced to an acceptably narrow band and the midpoint of that band is where it is intended to be. In the case on non-positive feed however, not only is the size band extremely wide but also its peaks stray away from the intended sock size for that particular batch. The effect of this straying is not only to produce a pairing problem but also merchandise which is heavier in weight than originally intended, with the consequent over use of yarn.

A similar test has been carried out using a sock type knitted from 2/100's denier nylon plated on 1/50's combed cotton. With this less stable fabric the result was achieved that when knitting in positive feed 100% of the goods were in the size tolerance band of ±0.25 inch of the norm, whereas when not using positive feed the figure dropped to 50%, and no less than 70% of the socks produced in the test with positive feed were actual size. This particular style using nylon plated on cotton had a normal reject rate for bad plating of between 5 and 10%. When the positive feed control system of the invention was fitted this reject figure dropped to zero.

Tests on machines knitting 12 gauge fashioned wool/nylon long socks, using two different but similar machines one being equipped with the control system of the present invention and the other without, produced results which were equally encouraging. The sample which equated to approximately one month's production from one machine had a specification of 11½ inch foot and a 20 inch leg. The goods from both the positive and non-positive feed machines were monitored and marked at each of seven stages of production (scour, shrink resist, dye, soften, hydro-extract, tumble dry, and board and examine) with no special instructions being given to the operatives during processing. All aspects of the product showed an improvement, the most interesting and dramatic being the control of leg length. The analysis showed that with the present control system leg lengths had a 96% chance of falling between 19½ and 20½ inch, the standard tolerance, compared with 66½% of the batch made without the influence of the programmed positive feed provided by the invention.

All the foregoing tests were carried out in the factories of actual sock manufacturers, under production conditions. The electronic control system which has been described has the special advantage of being able to cope with the variations in yarn feed which are a feature essential to the production of fashioned hose.

Referring to the described embodiment, although the speed of positive feed pin wheel or motor gearbox output shaft are monitored to derive the speed of the yarn feed it will be appreciated that the speed of the yarn feed can also be derived by sensing the speed of the drive belt itself or motor output shaft.

Figure 2:
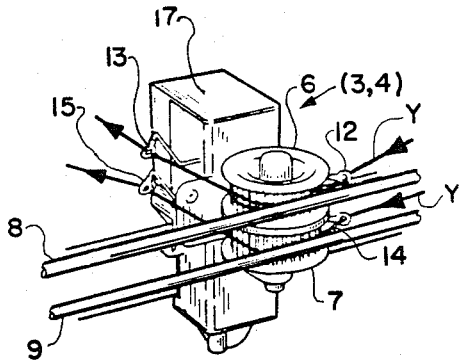
FIG. 2 is a detail view, to a larger scale, of the pin wheel mechanism shown in FIG. 1.

With regard to the path of the yarn around the pin wheels, the yarn can be fed around only a portion of the wheel periphery as shown on pinwheel 7 in FIG. 2, or can be looped fully around the pinwheel as shown on pinwheel 6 in FIG. 2. In either case it is preferable for the pinwheel to be driven at a higher speed when the yarn is out of positive feed to provide a "yarn assist" feed. Because of yarn slip the yarn will not, of course, then be fed at the pinwheel driven speed.

Finally, Tables I to IX of the drawings illustrate a flow chart detailing the steps carried out during operation of the system.

We claim:

1. A system for applying positive yarn feed to a circular knitting machine, comprising:
   - a positive yarn feed device for feeding yarn to the circular knitting machine;
   - a variable-speed electric motor drive for said positive yarn feed device, said motor drive being independent of the drive of said knitting machine;
   - first speed sensing means for sensing the speed of a knitting cylinder of the circular knitting machine and supplying a first electrical signal representative of the speed of said knitting cylinder;
   - second speed sensing means for supplying a second electrical signal representative of the speed of said positive yarn feed device;
   - programmable storage means for storing a preselected speed ratio signal representative of a desired ratio of the speeds of said positive yarn feed device and said knitting cylinder; and
   - control means for comparing said first and second signals to produce an actual speed ratio signal, comparing said actual speed ratio signal with said preselected speed ratio signal and controlling the speed of said positive yarn feed device in dependence on said comparison.

2. A system as claimed in claim 1 wherein said storage means is operable to store a second preselected speed ratio signal and a preselected course signal representative of a preselected number of courses knitted by the knitting machine; and further comprising a counter means for counting a number of courses knitted by said machine and supplying a count signal representative of said number; and
   - means for comparing said count signal with said preselected course signal and in dependence on said comparison supplying said second preselected speed ratio signal to said control means for comparison with said actual speed ratio signal.

3. A system as claimed in claim 2 wherein said storage means is operable to store a plurality of said preselected speed ratio signals and a plurality of associated said preselected course signals, and said comparing means is operable to supply said preselected speed ratio signals to said control means as a function of said preselected course signals.

4. A system as claimed in claim 3 wherein said control means is operable to engage or disengage yarn from said positive yarn feed device in response to receipt of a pre-defined speed ratio signal.

5. A system as claimed in claim 2 further comprising a reset switch operable to supply a reset signal to said counter means at the end of a knitting cycle.

6. A system as claimed in claim 2 wherein said variable-speed electric motor drive includes a DC motor; and further comprising a DC drive unit for modulating the armature current at said DC motor to control the speed thereat, said DC drive unit being controlled by said control means.

7. A system as claimed in claim 3 wherein said storage means is of EPROM type and can be programmed by a hand-held keypad terminal.

8. A system as claimed in claim 7 wherein said terminal is of plug-in form, so that the same terminal can be used to program a number of machines.

9. A system as claimed in claim 8 wherein said terminal incorporates a digital display of information comprising an instantaneous yarn speed per machine revolution and a position of the knitting machine within its operative cycle.

10. A system as claimed in claim 3 wherein said positive yarn feed device incorporates a pin wheel mechanism, with said second speed sensing means providing a signal representative of the speed of a quality wheel of said pin wheel mechanism and hence representative of the speed of said pin wheel.

11. A system as claimed in claim 10 wherein said pin wheel mechanism includes at least one tandem pin wheel unit with each said unit having two pin wheels and with each wheel of said two pin wheels being independently driven by separate tapes and individual quality wheels.

12. A system as claimed in claim 11 wherein said quality wheels are of adjustable diameter to provide differential feed speeds for associated feed yarns by appropriate relative adjustment of said quality wheels.

13. A system as claimed in claim 11 wherein separate variable-speed motor drives are provided for said two quality wheels with each drive being associated with its own second sensing means to provide independent feedback speed control of said two pin wheels.

14. A system as claimed in claim 13 wherein said first and said second speed sensing means are of digital type and produce a train of pulses a count of which is indicative respectively of the number of revolutions of said knitting machine cylinder and said positive yarn feed drive.

* * * * *